US006782933B2

(12) United States Patent
Marschke

(10) Patent No.: US 6,782,933 B2
(45) Date of Patent: Aug. 31, 2004

(54) SINGLE FACER QUICK CHANGE CORRUGATING ROLLS

(75) Inventor: Carl R. Marschke, Phillips, WI (US)

(73) Assignee: Marquip, LLC, Phillips, WI (US)

( * ) Notice: Subject to any disclaimer, the term of this patent is extended or adjusted under 35 U.S.C. 154(b) by 237 days.

(21) Appl. No.: 10/000,514

(22) Filed: Oct. 23, 2001

(65) Prior Publication Data

US 2003/0075263 A1 Apr. 24, 2003

(51) Int. Cl.[7] ..... B21B 31/10; B21B 31/12; B31F 1/28

(52) U.S. Cl. ..... 156/472; 414/911; 72/238; 425/186; 425/194; 425/367

(58) Field of Search ..... 156/205, 209, 156/210, 470, 471, 472, 473; 414/911; 72/238, 239, 196; 425/186, 194, 367, 369, 336; 264/286, 287; 493/463

(56) References Cited

U.S. PATENT DOCUMENTS 4,071,392 A * 1/1978 Chaudhuri ..... 156/351
4,569,714 A * 2/1986 Tokuno ..... 156/471
4,627,831 A 12/1986 Hirakawa et al.
4,629,526 A 12/1986 Kanda
4,631,109 A 12/1986 Hirakawa et al.
4,738,744 A 4/1988 Saller
4,773,963 A 9/1988 Seki et al.
4,814,038 A 3/1989 Hayashi et al.
5,628,865 A 5/1997 Marschke
5,950,477 A * 9/1999 Matsunaga ..... 72/239
5,951,816 A 9/1999 Marschke
6,012,501 A 1/2000 Marschke

* cited by examiner

*Primary Examiner*—Jeff H. Aftergut
*Assistant Examiner*—Barbara J. Musser
(74) *Attorney, Agent, or Firm*—Andrus, Sceales, Starke & Sawall, LLP

(57) ABSTRACT

A corrugator single facer of the type utilizing a large diameter bonding roll and a small diameter corrugating roll provides quick roll change capability by mounting three large diameter bonding rolls on a rotatable turret and carrying corresponding small diameter corrugating rolls in a magazine positioned laterally offset from the machine. By driving the corrugating rolls indirectly through the pressure belt arrangement which supports the lower corrugating roll, roll change is significantly simplified.

7 Claims, 8 Drawing Sheets

SINGLE FACER QUICK CHANGE CORRUGATING ROLLS

FIELD OF THE INVENTION

The invention pertains to a single facer apparatus for forming a single face web of corrugated paperboard. More particularly, the invention relates to a corrugating roll assembly comprising a large diameter corrugating roll (i.e. a bonding roll) and a small diameter corrugating roll in which alternate pairs of large and small corrugating rolls with different flute patterns may be rapidly changed.

BACKGROUND OF THE INVENTION

In the manufacture of corrugated paperboard, a single facer apparatus is used to corrugate the medium web, to apply glue to the flute tips on one face of the corrugated medium web, and to bring a liner web into contact with the glued flute tips of the medium web with the application of sufficient heat and pressure to provide an initial bond. For many years, conventional single facers have typically included a pair of fluted corrugating rolls and a pressure roll, which are aligned so that the axes of all three rolls are generally coplanar. The medium web is fed into a corrugating nip formed by the interengaging corrugating rolls. While the corrugated medium web is still on one of the corrugating rolls, adhesive is applied to the flute tips by a glue roll. The liner web is immediately thereafter brought into contact with the adhesive-coated flute tips and the composite web then passes through the nip formed by the corrugating roll and the pressure roll.

In the past, the fluted corrugating rolls have typically been generally the same size as each other. More recently, a significantly improved single facer apparatus has been developed in which the corrugating rolls comprise a large diameter bonding roll and a substantially smaller diameter roll, with the ratio of diameters being 3:1 or greater. Such apparatus is disclosed in U.S. Pat. Nos. 5,628,865, 5,951,816, and 6,012,501, all which disclosures are incorporated herein by reference. In accordance with these disclosures, the single facer typically includes a backing arrangement for the small diameter corrugating roll. One preferred backing arrangement includes a series of axially adjacent pairs of backing idler rollers, each pair having a backing pressure belt entrained therearound. Each of the pressure belts is positioned to bear directly against the fluted surface of the small diameter corrugating roll on the side of the small corrugating roll opposite the corrugating nip. Each pair of associated idler rolls and pressure belts is mounted on a linear actuator, and can thus engage the small diameter corrugating roll with a selectively adjustable force. The application of force against the small diameter corrugating roll, in turn, applies force along the corrugating nip between the small diameter roll and the large diameter roll and along the full length of the nip.

In my co-pending application, filed on Oct. 9, 2001 and entitled "Single Facer Drive Apparatus", a single facer apparatus is disclosed in which the pressure belt arrangement for supporting the small diameter corrugating roll also provides rotatable drive to the small diameter roll from which driving rotation is transmitted through the nip to the large diameter corrugating roll.

There have been many attempts in the prior art to construct a single facer with interchangeable corrugating roll pairs so that a flute change can be made quickly and easily. Various types of apparatus have been designed for this purpose, including pairs of upper and lower corrugating rolls each mounted a rotatable spindle to change from one roll pair to another. Other constructions have provided means for simply lifting the rolls from operating position and replacing them with another pair.

With the introduction of the current state-of-the-art single facer using a large diameter bonding roll, roll replacement has become more difficult, even though the ability to rapidly change corrugating roll pairs remains just as important. It would, therefore, be most desirable and advantageous to provide for a quick corrugating roll pair change in a modern single facer of the type utilizing a large diameter bonding roll in cooperation with a much smaller corrugating roll.

SUMMARY OF THE INVENTION

In accordance with the present invention, three matching pairs of large diameter and small diameter corrugating rolls may be easily interchanged. The interchangeable large diameter corrugating rolls are carried on a rotatable turret and the small diameter corrugating rolls are supplied from a storage magazine positioned laterally offset from the turret and the single facer machine.

More specifically, a single facer apparatus for producing a single face web from a corrugated medium web and a liner comprising a rotatable turret carrying at least two, but preferably three, independently rotatable large diameter fluted bonding rolls on parallel rotational axes, a positioning device that is operable to rotate the turret to place a bonding roll into an operative position, a magazine carrying at least two, but preferably three, small diameter fluted corrugating rolls in a storage position offset laterally from the turret and the bonding rolls, a transfer device that is operable to move a corrugating roll axially from the magazine into an operating position adjacent the bonding roll in the operative position, and a corrugating roll support device to rotatably support the corrugating roll in operative engagement with the bonding roll. In the preferred embodiment, the transfer design is operable to move a corrugating roll axially to and from the operating position in the single facer and the storage position in the magazine.

DETAILED DESCRIPTION OF THE PREFERRED EMBODIMENT

Figure 1:
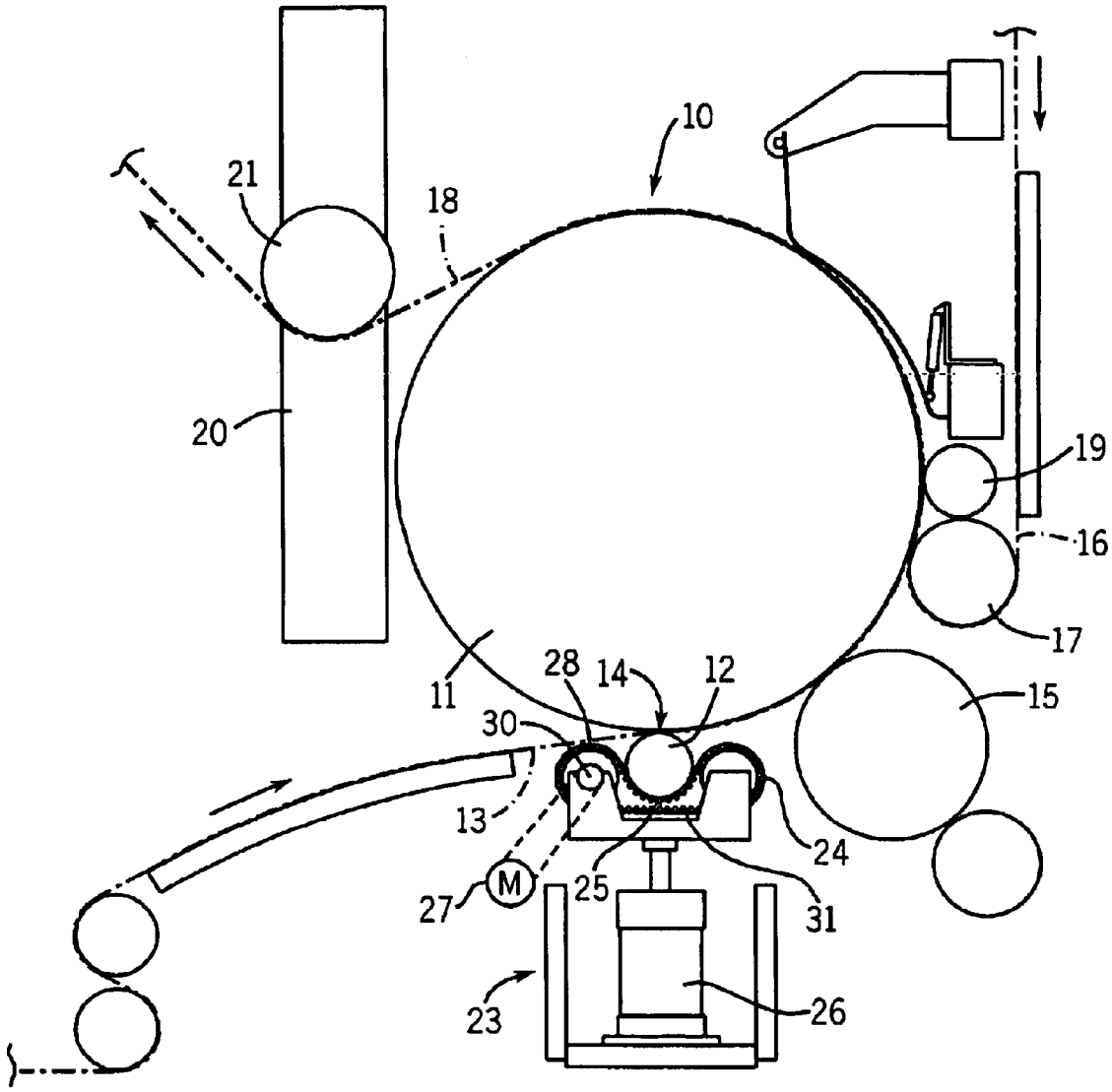
FIG. 1 is a side elevation view of a current state-of-the-art single facer incorporating a corrugating roll drive arrangement of a type especially suitable in a single facer of the present invention.

Referring initially to FIG. 1, a single facer 10 includes a large diameter upper corrugating roll 11 (sometimes hereinafter referred to as bonding roll 11) and a much smaller diameter lower corrugating roll 12. Both rolls 11 and 12 may be made of steel or other suitable materials and are fluted and mounted for interengaging rotational movement on parallel axes, all in a manner well known in the art, as described in detail in the above identified patents and patent applications. A medium web 13, which is typically pretreated by moistening and heating, is fed into a corrugating nip 14 formed by the interengaging corrugating rolls 11 and 12. As the corrugated medium web 13 leaves the nip 14, it remains on the surface of the large diameter bonding roll 11. Immediately downstream from the nip 14 a glue roll 15 applies a liquid adhesive, typically starch, to the exposed flute tips of the corrugated medium web 13. Immediately thereafter, a liner web 16 is brought into contact with the glued flute tips of the corrugated medium web by a liner delivery roll 17, sometimes referred to as a generator roll. The resulting freshly glued single face web 18 continues around a portion of the outer circumference of the large diameter bonding roll 11. The initial bond between the medium web 13 and liner web 16 may be assisted with a soft contact roll 19 located immediately downstream from the delivery roll 17. The soft contact roll 19 presses the composite single face web 18 against the bonding roll 11 with a light and uniform force distributed across the full width of the web. Because the large diameter roll 11 also functions as a bonding roll, it is internally heated, for example with steam, to cause the starch adhesive to initially gelatinize and then enter the so-called "green bond" stage. By assuring that green bond is reached while the single face web 18 is still on the bonding roll 11, integrity of the glue lines is better assured and downstream handling, including back wrapping around a wrap roll 21, is not likely to disturb the bond. The extent of the wrap of the single face web 18 on the bonding roll and thus the circumferential residence time of the single face on the bonding roll may be varied by adjustably positioning the wrap roll along a positioning mechanism 20. The vertical position of the wrap roll 21 with respect to the surface of the bonding roll 11 may be selectively adjusted depending on a number of variables, such as paper weight, web speed, bonding roll temperature, starch composition, and the like. Alternately, the position of the wrap roll may be fixed, particularly in the construction of the preferred embodiment described below with respect to FIGS. 2–8.

In the single facer shown in FIG. 1, the large diameter corrugating and bonding roll 11 typically has a diameter of about 39 inches (about 1,000 mm) and the smaller diameter lower corrugating roll 12 typically has a diameter of about 5 inches (about 130 mm). The prior art identified above and incorporated herein provides various backing arrangements for the small diameter roll 12, one of which backing arrangements 23 is shown in the drawing. The backing arrangement 23 includes a series of axially adjacent pairs of backing rolls 24, each of which pairs has a pressure belt 25 entrained therearound. Each of the pressure belts 25 is positioned to bear directly against the fluted outer surface of the small diameter corrugating roll 12. Each pair of idler rolls 24 and its respective pressure belt 25 is mounted on an actuator 26. By individually controlled operation of each actuator 26, the pressure belts may be made to engage the small diameter corrugating roll 12 with a selectively adjustable force. In current state-of-the-art single facers, the large diameter bonding roll 11 is typically driven by the main drive motor. In accordance with the invention described in my co-pending application identified above, however, all of the axially aligned backing rolls 24 on one side of the lower corrugating roll 12 are converted from idler rolls to drive rolls 28. The drive rolls 28 are mounted on a common drive shaft 30, the lateral outer end of which is operatively connected to a main drive motor 27. The drive rolls 28 are provided with a toothed outer surface to cooperate with a correspondingly toothed pressure belt 25 which may be conveniently in the form of a conventional reinforced rubber timing belt 31. By driving the drive rolls 28 together and applying an appropriate backing force to the backing arrangement 23 with the actuators 26, the lower corrugating roll 12 may be suitably driven due to approximately 90° or more of wrap of the pressure belts 25 around the roll 12. The driving force is transmitted through the nip 14 to the bonding roll 11.

Referring now to FIGS. 2–5, there is shown an improved single facer 32 of the present invention in which multiple corrugating roll pairs may be changed to provide different flute patterns. The corrugating roll pair interchange system of this invention is preferably used with the indirect corrugating roll drive described in detail in my co-pending application filed concurrently herewith.

The single facer 32 includes a large diameter bonding roll 33 in operative position and mounted on a rotatable turret 34 with two similar bonding rolls 33. Rotation of the turret 34 on its axis 35 brings a selected one of the bonding rolls 33 into operative position to form a nip 37 with a small diameter corrugating roll 36. Each of the large diameter bonding rolls 33 may be provided with a different flute pattern and, for the particular bonding roll chosen and rotated into operative position, the interengaging small diameter corrugating roll 36 must also be changed to one having a corresponding flute pattern.

In a manner similar to the single facer 10 shown in FIG. 1, a medium web 38 is fed into the corrugating nip 37 and, after corrugating, remains on the surface of the bonding roll 33. A starch adhesive is applied to the exposed flute tips of the corrugated medium web 38 on the bonding roll by a glue roll 40 and, immediately thereafter, a liner web 41 is brought into contact with the glued tips of the corrugated medium web delivered by a generator roll 42 to form a single face web 43. By retaining the freshly glued single face web 43 on the heated bonding roll 33 over a substantial extent of its circumference, an adequate green bond is formed in the glue lines such that, when the single face web 43 is taken off the bonding roll as by wrapping around an exit roll 44, the green bond strength is adequate to assure that the bond between the medium web 38 and liner web 41 is not disturbed.

Figure 4:
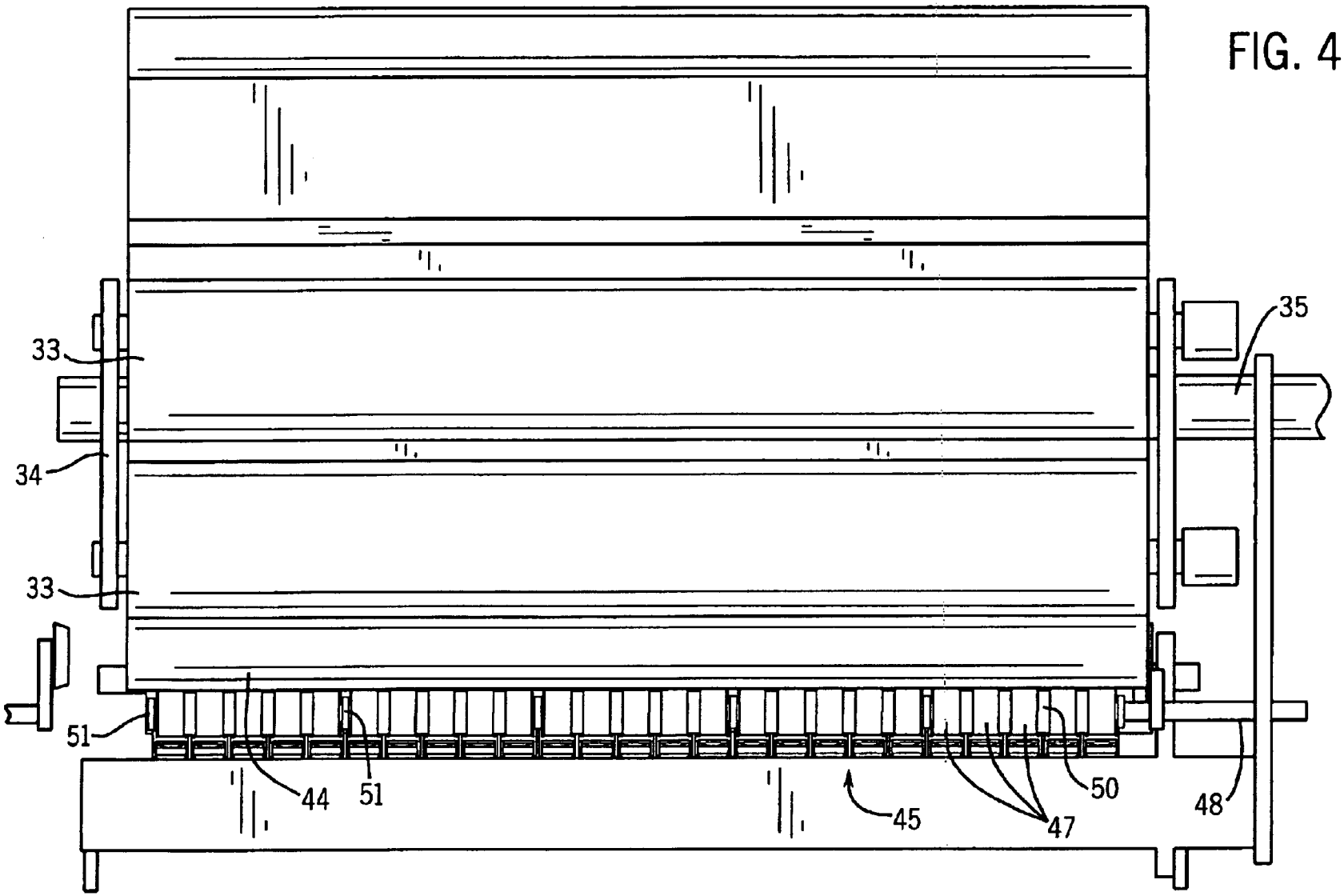
FIG. 4 is a rear elevation view of the single facer shown in FIG. 2 and showing details of the corrugating roll drove arrangement.
Figure 5:
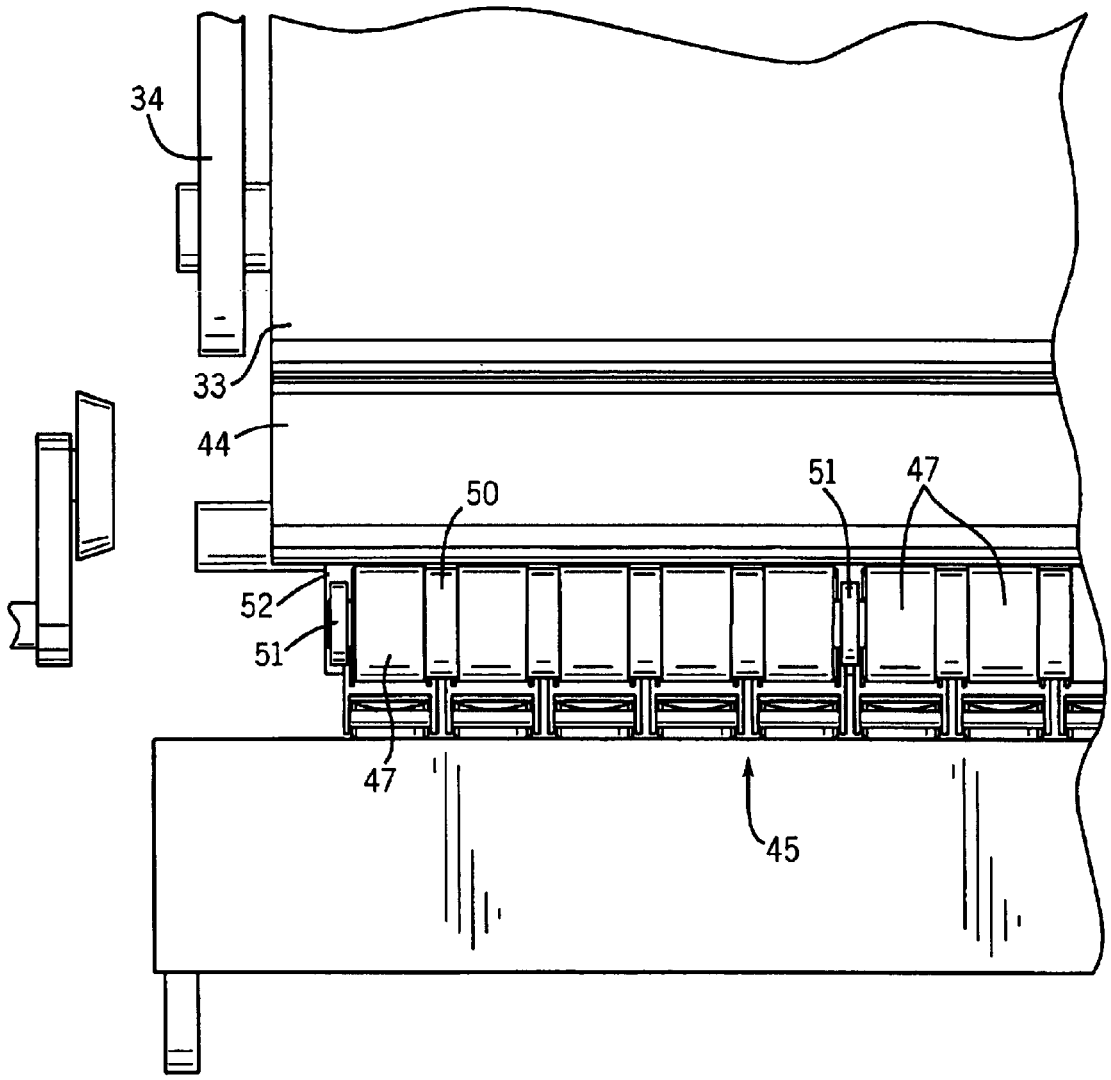
FIG. 5 is an enlarged detail of a portion of the apparatus shown in FIG. 4.
Figure 6:
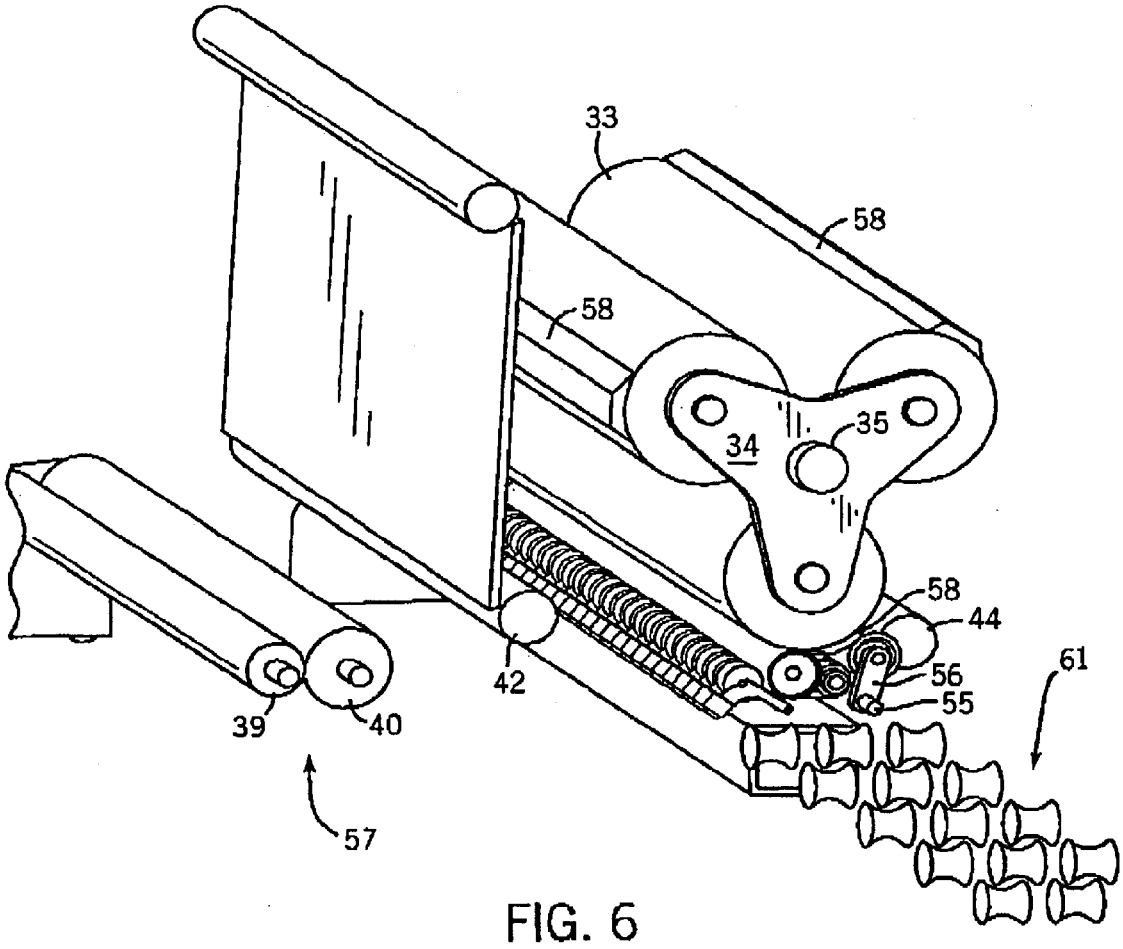
FIGS. 6–8 are isometric views of the single facer of the present invention showing details of the construction and sequential function of the device for changing the lower small diameter corrugating roll.
Figure 7:
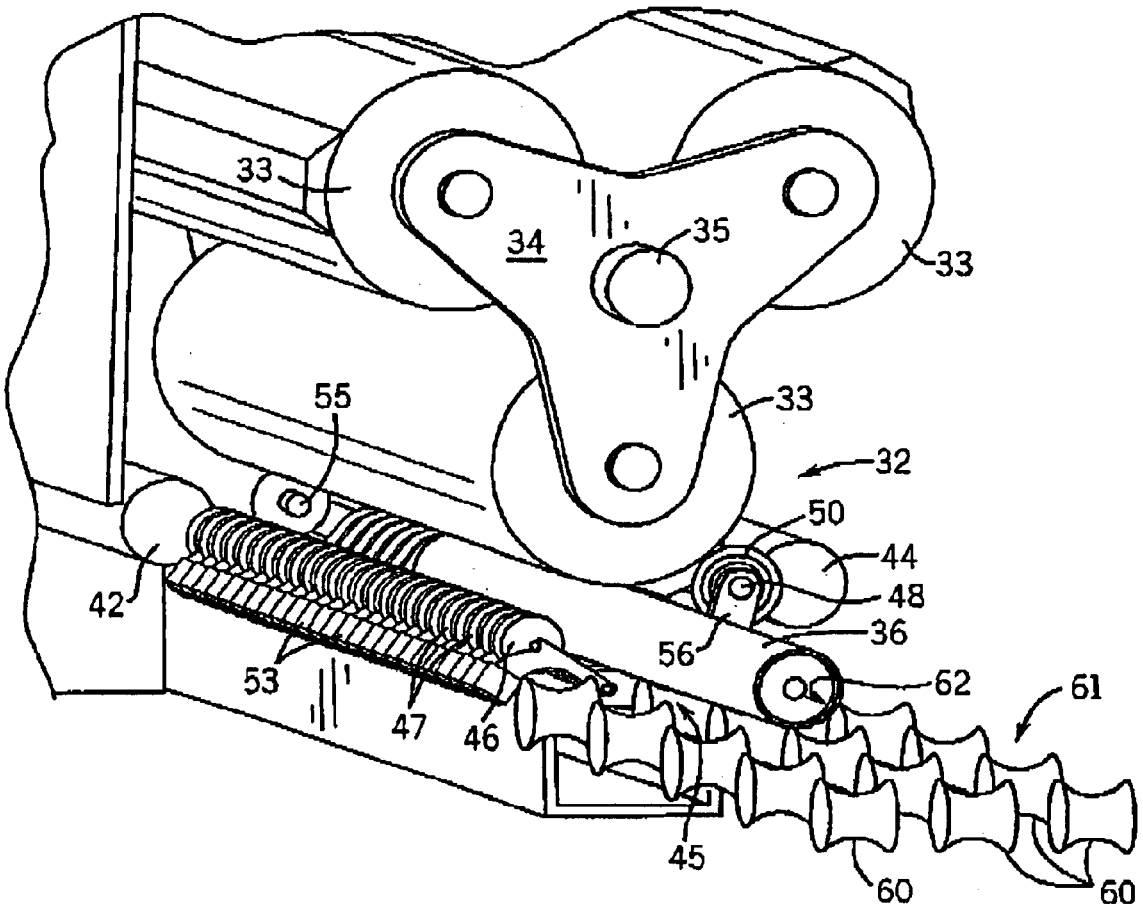
Figure 8:
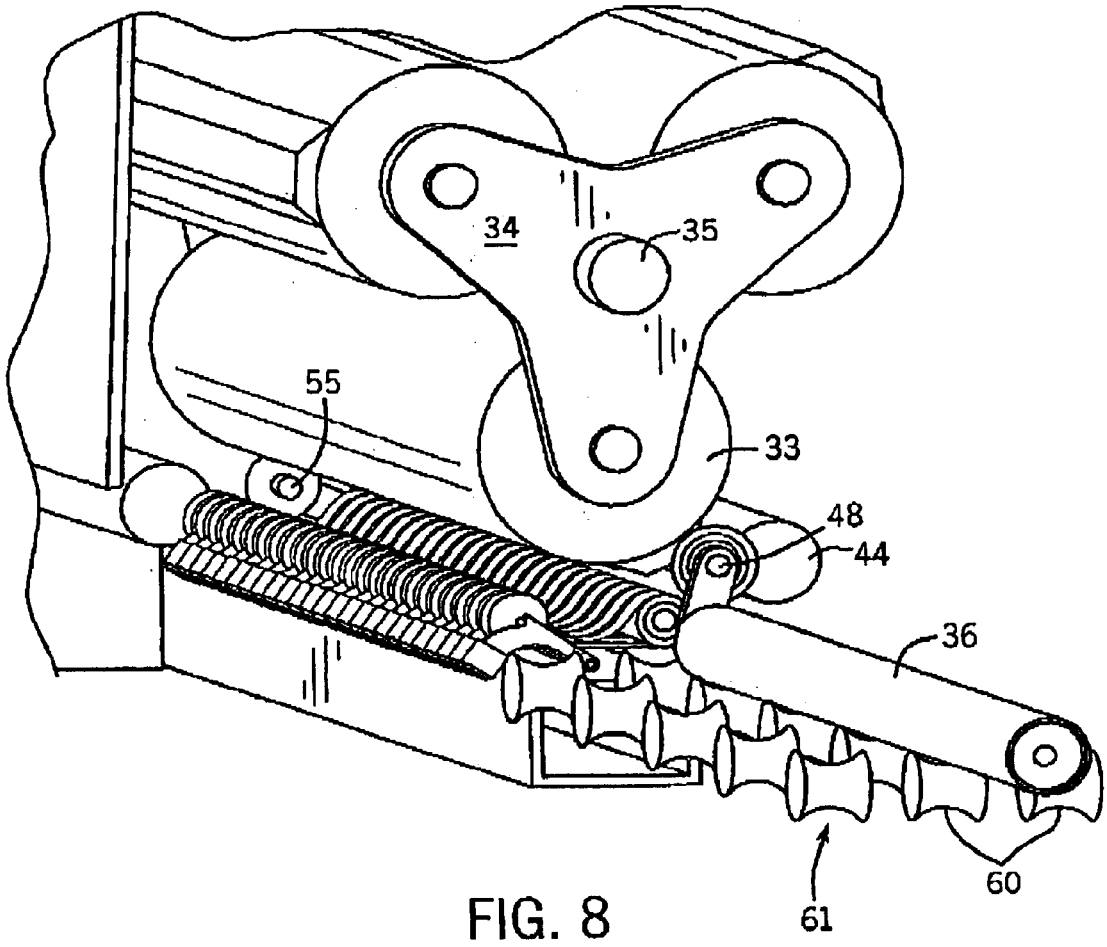

The small diameter corrugating roll 36 is supported to maintain an adequate nipping force and to prevent axial bending of the roll with a backing arrangement 45 that is similar to the backing arrangement 23 of the FIG. 1 embodiment. Thus, pairs of backing rolls 46 are positioned on opposite sides of the small diameter corrugating roll 36 and pressure belts 47 are entrained around the rolls and support the small diameter roll from beneath. However, one axially aligned row of backing rolls is mounted on a drive shaft 48 that extends across and beyond the full width of the machine in the cross machine direction. The rolls are keyed or otherwise fixed to the drive shaft 48 and act as drive rolls 50. Referring also to FIGS. 4 and 5, each drive roll 50 is provided with a toothed outer surface so that it may positively engage and drive pressure belts 47 also having a toothed construction in the manner of a timing belt. Each drive roll 50 is of extended axial length so that it can accommodate more than one pressure belt 47. In the embodiment shown, the drive roll 50 has an axial length adequate to carry five adjacent pressure belts. Between each drive roll 50 and at the outer ends of the two outermost drive rolls, the drive shaft 48 is supported in bearings 51 conveniently mounted in split hanger brackets 52 to facilitate removal of the drive shaft and drive rolls to change the pressure belts 47.

The opposite row of backing rolls 46 may be comprised of the same idler rolls 24 described with respect to the FIG. 1 embodiment, each carrying a single pressure belt 47. In other words, each drive roll 50, carrying five pressure belts 47, will be interconnected thereby with five backing rolls 46.

The backing arrangement 45 of this embodiment also differs from the FIG. 1 embodiment in the manner in which the backing force on the small diameter corrugating roll 36 is applied. Because it is necessary or at least highly desirable not to move the axis of the drive shaft 48 and drive rolls 50, the backing arrangement 45 is arranged to mount each backing roll 46 on its own pivot arm 49 and to place the loading actuators 53 below each of the backing rolls 46 and in operative engagement with the pivot arms. The actuators 53 may comprise pneumatic cylinders, air bags, or any other suitable device. In operation, the actuators 53 are extended to pivot the arms 49 and backing rolls 46 upwardly around the common axis of the opposite ends of the arms 49, causing the pressure belts 47 to load the small diameter corrugating roll 36 against the bonding roll 33 at the nip 37. The main drive motor 54 is operatively connected to one outer end of the drive shaft 48 (see FIG. 2), whereby the drive rolls 50 impart driving rotation to the backing rolls 46 and pressure belts 47. Pressure belt movement imparts rotation to the small corrugating roll 36 which is transmitted through the nip to the bonding roll 33 causing it to rotate with the small corrugating roll.

Figure 2:
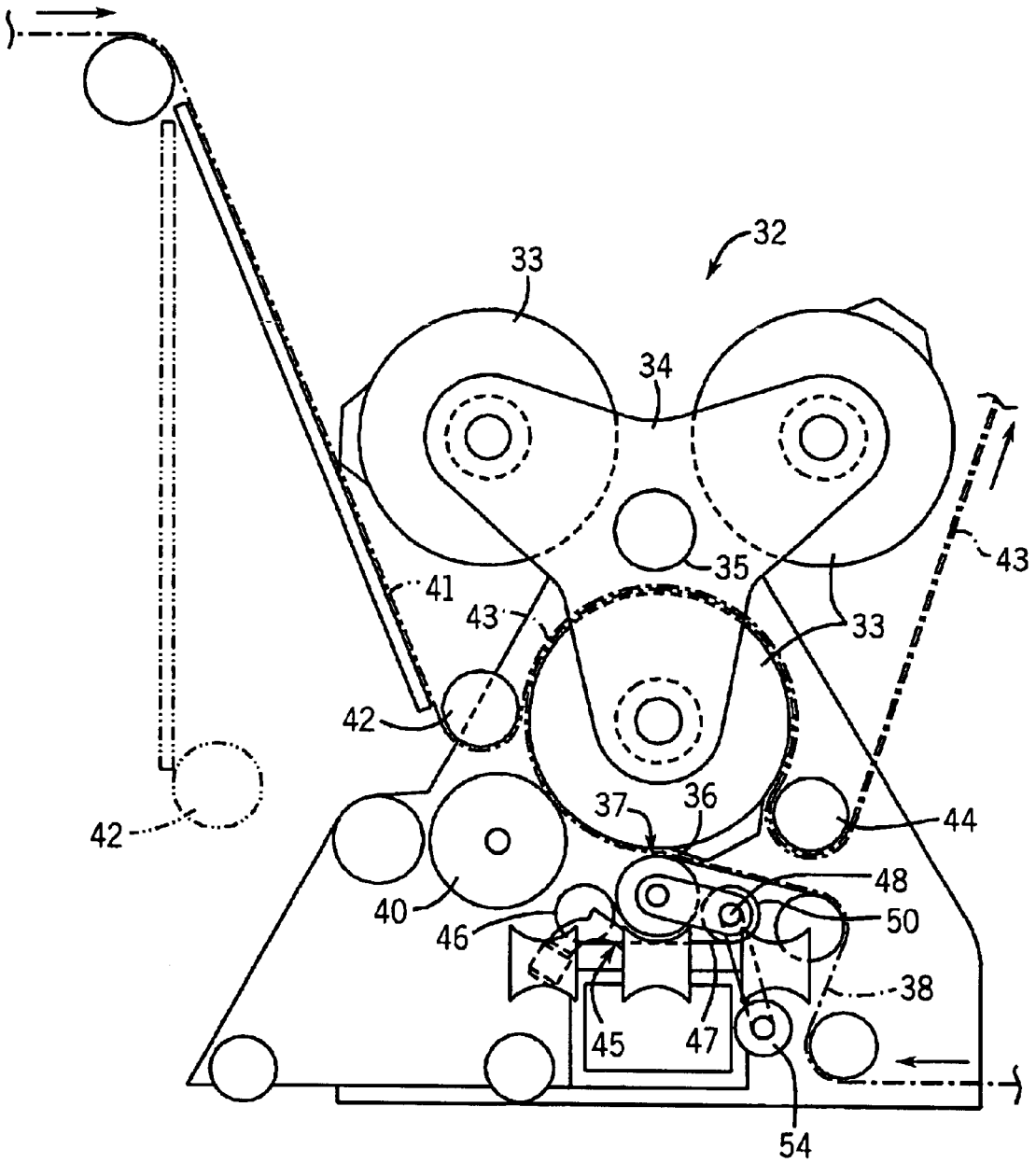
FIG. 2 is a side elevation view of the single facer of the present invention.
Figure 3:
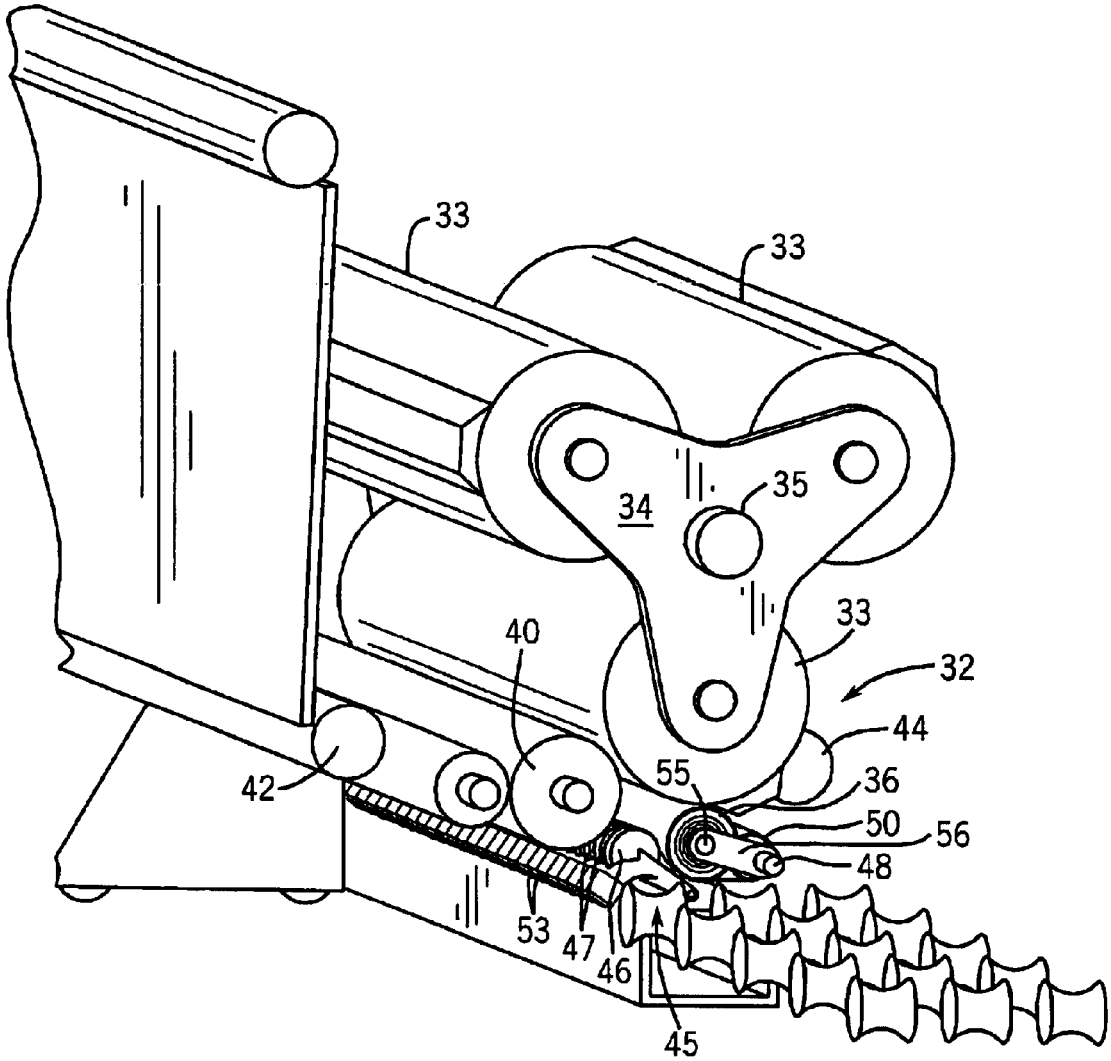
FIG. 3 is an isometric view of the apparatus shown in FIG. 2.

As shown in its operative position in FIG. 3, the small diameter corrugating roll 36 is supported by the pressure belt arrangement 45 and is also supported for rotation on its axis on the stub shaft 55 of a spindle 56. The spindle is mounted for angular pivotal movement on the drive shaft 48 and is also movable axially with respect to the small corrugating roll 36 so that the stub shaft 55 can be withdrawn from rotational support thereof. When it is desired to change the corrugating roll pair 33 and 36, and referring also to FIG. 6, the glue roll 40 and its associated metering roll 39 are mounted on a separate carriage 57 which is moved laterally away from the corrugating rolls. The generator roll 42 is also swung away from the single facer (as best seen in FIG. 1). On the other side of the machine, the exit roll 44 is also dropped down and away from the bonding roll 33. All of the foregoing movements are to provide clearance for the movement of the bonding rolls and the turret 34 on which they are mounted. It should be noted that each bonding roll 33 on the turret carries with it a separate vacuum plenum 58. The use of a vacuum plenum is well known in the art and it is positioned, as shown in FIGS. 2 and 3, in an operative position to apply a vacuum through a series of grooves and passages to the surface of the bonding roll to assist in maintaining the single face web in contact therewith.

To complete the preparation of the machine for corrugating roll exchange, the actuators 53 in operative contact with the backing idler rolls 46 are retracted to drop the rolls and the pressure belts. The stub shaft 55 is withdrawn axially from the end of the small corrugating roll 36 and the spindle 56 pivoted upwardly and out of the way. The small diameter corrugating roll 36 is then clear for withdrawal from the machine in the lateral or cross machine direction along its axis. The small diameter corrugating roll 36 is shown partially withdrawn in FIG. 7 where the leading end of the roll is supported on a series of aligned support rolls 60 of a magazine 61. The magazine includes sets of parallel support rolls 60 which support similar corrugating rolls (not shown) each having a flute pattern matching that of one of the bonding rolls 33. When the small diameter roll 36 is fully withdrawn from the machine, the turret 34 is rotated to bring a new bonding roll 33 into position and the magazine 61 is indexed sideways to bring the small diameter corrugating roll 36 matching the new bonding roll 33 into loading position. The process just described for removing the small corrugating roll is reversed and the new roll brought into operative position above the pressure belts 47 and below the bonding roll 33.

One type of apparatus for extracting the small diameter corrugating roll 36 from the machine, placing it in the magazine 61, and moving the new small roll into position in the machine is an extractor mechanism that engages a lip 62 on the end of the roll 36. By engaging the lip, the extractor mechanism can be used to pull the roll from its operative position in the single facer onto the magazine 61, and to push the replacement small diameter corrugating roll 36 from the magazine into position between the pressure belts 47 and the newly selected bonding roll 33. Alternately, a roll-supporting slide device could be utilized instead of the support rolls 60. To assist the axial movement of the small diameter corrugating roll 36 from its operative position to the storage magazine 61, a series of laterally spaced guides may be placed along the length of the small corrugating roll and between the pressure belts 47. When the backing arrangement including the pressure belts is lowered for roll change, the spaced guides will extend above the pressure belts and support the small roll as it is pulled from its operative position by the extractor mechanism.

In the single facer 32 of the present invention, the ratio of diameters of the large diameter bonding roll 33 to the small diameter corrugating roll 36 is preferably smaller than in the present state-of-the-art machine 10 shown in FIG. 1. In the preferred embodiment of the present invention, the large diameter bonding roll may have a diameter of about 22.5 inches (570 mm) and the small diameter roll a diameter of about 7.5 inches (190 mm), a ratio of 3:1. By utilizing the indirect corrugating roll drive described herein, direct mechanical driving connection to the large bonding roll 33 (or the small corrugating roll 36) is eliminated, leaving only steam supply and condensate removal to be provided to the turret 34. In most cases, it will be necessary to have a separate vacuum plenum 58 to be carried with each of the bonding rolls 33 because variations in flute patterns from one roll to another also typically result in changes in vacuum groove patterns as well. As indicated above, because the diameter of the large bonding roll 33 in the preferred embodiment of FIG. 2 is substantially smaller than the diameter of the bonding roll 11 in the current state-of-the-art single facer shown in FIG. 1, it is preferable to fix the operating position of the exit roll 44 in the preferred embodiment at a point that maximizes the wrap of the single face web 43 on the bonding roll. Elimination of the exit roll positioning mechanism (20 in FIG. 1) also simplifies the construction of the single facer. As may be seen in FIG. 2, the improved single facer of the present invention still provides the capability for more than 180° of circumferential wrap of the single face web on the bonding roll 33.

It may also be desirable to utilize an alternate means for driving the corrugating rolls 33 and 36 from the drive disclosed herein which is the subject of my co-pending application entitled "Single Facer Drive Apparatus". In such an alternate drive arrangement, the main drive motor 54 is provided with a driving connection directly to the small diameter corrugating roll 36. Preferably, the drive connection is made at the axial opposite end of the roll from that shown in the drawings (in other words, at the roll end opposite the spindle 56 and roll supporting hub 55). The drive connection to the small diameter corrugating roll 36 could be a drive cone, a splined stub shaft or any similar arrangement which would allow the roll to be withdrawn axially for roll change and a new roll to be easily connected to the drive.

I claim:

1. A single facer apparatus for the production of a single face web from a corrugated medium web and a liner web, said apparatus comprising:

a rotatable turret carrying at least two independently rotatable large diameter fluted bonding rolls on parallel rotational axes;

a positioning device operable to rotate the turret to place one of the bonding rolls into an operative position;

a storage device carrying at least two small diameter fluted corrugating rolls in a storage position offset laterally, from the turret and the bonding rolls;

a transfer device operable to move a corrugating roll axially from the storage device into an operating position adjacent the bonding roll in the operative position; and, a corrugating roll support device to rotatably support the corrugating roll, said support device including a pair of stub shafts in engagement with the opposite ends of the operative small diameter corrugating roll on the axis thereof, at least one of said stub shafts being separable from and movable axially and radially out engagement with an end of the operative corrugating roll, and a pressure belt arrangement operative to hold the small diameter corrugating roll in nipping engagement with the operative large diameter roll; and, a drive arrangement operatively connected to said support device to transmit driving rotation to the operative corrugating roll.

2. The apparatus as set forth in claim 1 wherein said transfer device is operable to move a corrugating roll axially from the operating position to the storage position.

3. The apparatus as set forth in claim 1 wherein said drive arrangement comprises one of said stub shafts adapted to drivingly engage the small diameter roll, and further including a drive motor operatively connected to said one stub shaft to drive said small diameter roll.

4. The apparatus as set forth in claim 1 wherein said turret carries three bonding rolls and said storage device carries three corrugating rolls.

5. The apparatus as set forth in claim 4 wherein each bonding roll has associated with it a vacuum plenum device.

6. The apparatus as set forth in claim 1 wherein said pressure belt arrangement comprises a plurality of backing roll arrangements in operative rotatable engagement with the small diameter corrugating roll, each backing roll arrangement including pairs of backing rolls mounted on a support assembly and a pressure belt entrained around each pair of backing rolls and, wherein said drive arrangement comprises a common drive connection to one roll of each backing roll pair; and, a source of motive power operatively connected to the drive connection to rotatably drive said commonly connected backing rolls.

7. A single facer apparatus for the production of a single face web from a corrugated medium web and a liner web, said apparatus comprising:

a rotatable turret carrying at least two independently rotatable large diameter fluted bonding rolls on parallel rotational axes;

a positioning device operable to rotate the turret to place one of the bonding rolls into an operative position;

a storage device carrying at least two small diameter fluted corrugating rolls in a storage position offset laterally from the turret and the bonding rolls;

a transfer device operable to move a corrugating roll axially from the storage device into an operating position adjacent the bonding roll in the operative position; and, a corrugating roll support device to rotatably support the corrugating roll, in operative engagement with the bonding roll; including a pair of stub shafts in engagement with the opposite ends of the operative corrugating roll on the axis thereof, at least one of said stub shafts being separable from and movable axially and radially out of engagement with an end of the operative corrugating roll; a drive arrangement operatively connected to said support device to transmit driving rotation to the operative corrugating roll;

a pressure belt arrangement operative to hold the small diameter roll in nipping engagement with the large diameter roll; said pressure belt arrangement comprising a plurality of backing roll arrangements in operative rotatable engagement with the small diameter corrugating roll, each backing roll arrangement including pairs of backing rolls mounted on a support assembly and a pressure belt entrained around each pair of backing rolls and, wherein said drive arrangement comprises a common drive connection to one roll of each backing roll pair; and, a source of motive power operatively connected to the drive connection to rotatably drive said commonly connected backing rolls.

* * * * *